US007320957B2

(12) United States Patent
Brooker et al.

(10) Patent No.: US 7,320,957 B2
(45) Date of Patent: Jan. 22, 2008

(54) RINSE-AID COMPOSITION COMPRISING A MAGNESIUM SALT AND ZINC SALT MIXTURE

(75) Inventors: Anju Deepali Massey Brooker, Newcastle/Tync (GB); Harold Emmerson, Murcia (ES); Andrew Paul Nelson, Newcastle/Tyne (GB); Eric San Jose Robles, Newcastle/Tyne (GB); Brian Xiaoqing Song, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/343,135

(22) Filed: Jan. 30, 2006

(65) Prior Publication Data

US 2006/0189508 A1 Aug. 24, 2006

Related U.S. Application Data

(60) Provisional application No. 60/648,575, filed on Jan. 31, 2005.

(51) Int. Cl.
*C11D 1/82* (2006.01)
*C11D 1/825* (2006.01)
*C11D 7/10* (2006.01)

(52) U.S. Cl. ..... 510/514; 510/220; 510/222; 510/227; 510/235; 510/432; 510/485; 510/508; 510/521; 510/525; 510/466

(58) Field of Classification Search ..... 510/220, 510/222, 227, 235, 432, 485, 508, 514, 521, 510/525, 466
See application file for complete search history.

(56) References Cited

U.S. PATENT DOCUMENTS

| | | | | |
|---|---|---|---|---|
| 4,567,038 | A * | 1/1986 | Ciaudelli et al. | 424/59 |
| 4,741,855 | A * | 5/1988 | Grote et al. | 510/122 |
| 5,603,776 | A | 2/1997 | Lentsch et al. | |
| 5,880,088 | A | 3/1999 | Lentsch et al. | |
| 5,880,089 | A | 3/1999 | Lentsch et al. | |
| 6,557,732 | B2 | 5/2003 | Van Rompuy et al. | |
| 6,833,342 | B2 * | 12/2004 | Woo et al. | 510/280 |
| 6,838,078 | B2 * | 1/2005 | Wang et al. | 424/78.02 |
| 6,956,016 | B2 | 10/2005 | Speed et al. | |
| 7,078,462 | B2 | 7/2006 | Speed et al. | |
| 2002/0183222 | A1 | 12/2002 | Foley et al. | |
| 2003/0045437 | A1 * | 3/2003 | Ward | 510/218 |
| 2003/0119689 | A1 | 6/2003 | Hutton et al. | |
| 2003/0192130 | A1 | 10/2003 | Kaaret et al. | |
| 2004/0259749 | A1 | 12/2004 | Braeckman et al. | |
| 2005/0065058 | A1 | 3/2005 | Roselle et al. | |
| 2005/0143280 | A1 | 6/2005 | Nelson et al. | |
| 2005/0166333 | A1 | 8/2005 | Kaaret | |

FOREIGN PATENT DOCUMENTS

| | | | |
|---|---|---|---|
| EP | 1 245 666 A | | 10/2002 |
| EP | 1245666 | * | 10/2002 |
| WO | 99/41349 | * | 8/1999 |
| WO | WO 99/41349 A | | 8/1999 |

OTHER PUBLICATIONS

PCT International Search Report, 3 Pages, Mailed Jul. 4, 2006.

* cited by examiner

*Primary Examiner*—Charles Boyer
(74) *Attorney, Agent, or Firm*—Laura R. Grunzinger

(57) ABSTRACT

Rinse-aid composition comprising a polyalkoxylated trisiloxane surfactant and a non-ionic solubilising system having a cloud point above room temperature and an acidifying agent wherein the rinse-aid composition has a pH of from about 1 to about 4.5.

8 Claims, No Drawings

RINSE-AID COMPOSITION COMPRISING A MAGNESIUM SALT AND ZINC SALT MIXTURE

CROSS REFERENCE TO RELATED APPLICATION

This application claims priority to U.S. Provisional Application Ser. No. 60/648,575, filed Jan. 31, 2005, the disclosure of which is incorporated by reference.

TECHNICAL FIELD

The present invention is in the field of dishwashing, in particular it relates to rinse-aid compositions and a method for the preparation thereof. The compositions provide drying, finishing and care benefits for the treated articles.

BACKGROUND OF THE INVENTION

Rinse-aid composition comprising siloxane surfactants are known from the prior art. EP 875,556 discloses a rinse-aid composition for plasticware, comprising form 0.1 to 10% by weight of the composition of a certain polysiloxane copolymer. The pH of these compositions is not disclosed, neither is the method of making them.

Siloxane surfactants can present super-spreading properties, due to their low surface tension. These super-spreading properties give rise to anti spotting, filming, shine and drying benefits when siloxane surfactants are used in rinse-aid compositions. It has now been found that some siloxane surfactants are easily hydrolysed under alkaline or acidic conditions, thereby reducing their super-spreading performance.

Rinse-aid compositions are placed in the rinse-aid reservoir of a dishwashing machine. These compositions are usually acidic. The user will refill the rinse-aid reservoir when empty or getting low, therefore, any new rinse-aid composition should be at least compatible with acidic compositions in order to avoid the risk of the composition being destabilised if placed in the rinse-aid reservoir containing residues of an acidic composition.

On the other hand, rinse-aid compositions may need to be acidic in order to keep dissolved some of the rinse-aid ingredients.

A problem commonly found in tableware washed in a dishwashing machine, especially on glass items, is deterioration of the glass. The deterioration can be caused by two different mechanisms—corrosion and deposition. Deposition comes from dishwashing detergent ingredients that are deposited on the washed items and not removed during the dishwashing process. Corrosion is thought to happen by dissolution of the glass silica lattice via hydrolysis, accelerated by metal ion leaching due to the builders present in automatic dishwashing detergents. Corrosion can seriously deteriorate the appearance of glass items.

The aim of the present invention is to provide a rinse-aid composition stable under storage conditions, compatible with other rinse-aid compositions and capable of providing glass-care benefits.

SUMMARY OF THE INVENTION

According to a first aspect of the present invention, there is provided a rinse-aid composition, for use in automatic dishwashing, comprising a polyalkoxylated trisiloxane surfactant and a non-ionic solubilising system, the solubilising system having a cloud point above room temperature (i.e., 20° C.), and an acidifying agent wherein the rinse-aid composition has a pH of from about 1 to about 4.5, preferably from about 1.5 to about 3.5 and more preferably from about 1.8 to about 3 as measured in a 1% by weight of the solution of an aqueous solution at room temperature. The rinse-aid composition is preferably in the form of an aqueous clear composition. By "aqueous" is meant that the composition comprises at least 10%, preferably at least 20% by weight of the composition of water, by "clear" is meant that it is possible to read through a sample of 1 cm thickness, placed in a transparent container, with the naked eye writing of 14 pt times new roman font and that does not present cloudiness.

The "non-ionic solubilising system" can be a single non-ionic surfactant or a mixture thereof having a cloud point above room temperature (20° C.), preferably above 40° C., more preferably above 60° C. Rinse-aid compositions having solubilising systems with cloud points above 40° C. and preferably above 60° C., are suitable not only for stability during transport and storage but also for the stability of the product when in the rinse-aid reservoir of the automatic dishwashing machine. The dishwashing process usually takes place at high temperature, above 50° C., and therefore rinse-aid compositions, placed within the rinse-aid reservoir, are subjected to high temperature, which may destabilise the rinse-aid. The rinse-aid of the invention is stable even under this high temperature conditions.

Certain polyalkoxylated trisiloxane surfactants tend to hydrolyse under alkaline or acidic conditions, losing some of their beneficial properties, including wetting capacity which is believed to be linked to filming and spotting performance and other finishing benefits. Without being bound by theory, it is believed that in the compositions of the present invention the trisiloxane surfactant and the non-ionic surfactant(s), included in the solubilizing system, form a mixed micelle, this micelle protects the trisiloxane groups from the acidifying agent, precluding destabilization and phase separation of the rinse-aid composition that would be detrimental from the performance point of view.

In a preferred embodiment the solubilising system and the trisiloxane surfactant are in a weight ratio of at least about 1:1, preferably at least 2:1, more preferably at least 10:1, these ratios contribute to the protection of the trisiloxane groups. The composition of the invention is stable on transport, storage and in the rinse-aid reservoir In preferred embodiments the rinse-aid composition comprises from about 0.1 to about 10%, preferably from about 0.5 to about 5% and more preferably from about 1 to about 4% by weight of the composition of polyalkoxylate trisiloxane surfactant. Preferably, the composition of the invention will provide from about 1 to about 5,000 ppm, more preferably from about 2 to about 1,200 ppm and even more preferably from about 3 to about 60 ppm of trisiloxane surfactant in the rinse liquor. These levels are preferred from the spotting, filming and drying point of view. Preferably, the trisiloxane surfactant has ethoxy, propoxy groups or mixture thereof, as pendant groups. A preferred material is a trisiloxane surfactant having at least three ethoxy groups wherein the number of propoxy groups is smaller than the number of ethoxy groups.

In another preferred embodiment the solubilising system comprises a wetting surfactant having a surface tension of no more than about 35 mN/m, preferably no more than 25 mN/m and more preferably no more than about 21 mN/m, as measured in a 1% by weight aqueous solution at 20° C. Preferred wetting surfactants include non-ionic ethoxylated alcohols having an average of from about 4 to about 10 moles of EO per mol of alcohol and an average chain length of from about 6 to about 15 carbon atoms and mixtures thereof. The non-ionic alkyl ethoxylated wetting surfactants are preferably free of propoxy groups.

Preferably, the solubilising system comprises a mixture of a wetting surfactant and a low foaming non-ionic surfactant acting as a suds suppressor, preferably the wetting surfactant and the suds suppressor are in a weight ratio of at least 1:1, more preferably about 1.5:1 and even more preferably about 1.8:1. This is preferred from a performance point of view.

The rinse-aid composition of the invention provides spotting and filming benefits as well as rapid drying of the washed items, this reduces the possibility of corrosion on the washed articles, especially in the case of metallic objects. It also improves the shine of the washed articles, especially glass and ceramic articles. The composition is also stable and compatible with other acidic rinse-aid compositions.

In a preferred embodiment the rinse-aid composition of the invention comprises a glass-care agent selected from the group consisting of water-soluble salts of at least one metal selected from aluminium, zinc, magnesium, calcium, lanthanum, tin, gallium, strontium, titanium, and mixtures thereof. The use of a mixture of zinc and magnesium salt is preferred from the environmental and economic point of view. Specially preferred are mixtures of magnesium and zinc salts in a weight ratio of at least about 5:1, more preferably at least about 10:1 and even more preferably at least about 20:1. Preferred salts for use here in are chloride salts.

A problem found with magnesium salts, especially in compositions of the kind of the present invention, is the difficulty to solubilize the salts and to avoid phase separation. The present inventors have found that magnesium salts can be stabilised in the rinse-aid composition by using an organic solvent system. The organic solvent system can be a single solvent or a mixture thereof. Ethanol or 1,2-propanediol are the preferred solvents to use in a single solvent system. More preferred is the use of mix-systems, especially preferred mixtures are those comprising an alcohol (an organic solvent comprising one OH group) and a polyol (an organic solvent comprising more than one OH group). Most preferred mix-system are those comprising ethanol and 1,2-propanediol. It is also preferred that the solvent system for the magnesium salt has a flash point above room temperature, more preferably above 40° C. and even more preferably above 60° C.

According to a second aspect of the invention, there is provided a rinse-aid composition comprising a magnesium salt, optionally a zinc salt and/or a solvent system for the magnesium salt comprising an alcohol and a polyol. Preferably the composition is acidic, having a pH of from about 1 to about 4.5, preferably from about 1.5 to about 3.5 and more preferably from about 1.8 to about 3 as measured in a 1% by weight of the solution of an aqueous solution at room temperature. This rinse-aid can optionally comprises the same ingredients and be in the same physical form as the rinse-aid composition according to the first aspect of the invention.

In a process aspect of the invention, there is provided a process for making rinse-aid compositions of the invention comprising trisiloxane surfactant a non-ionic solubilising system. The process comprises the steps of:

a) forming a premix of the trisiloxane surfactant with the solubilising system; and
b) adding the resulting premix to the acidifying agent and remaining ingredients.

A clear stable rinse-aid composition is achieved by this process. Without being bound by theory, it is believed that step a) allows the formation of a mixed miscelle system which protects the trisiloxane surfactant, avoiding its degradation by hydrolysis when contacted with the remaining ingredients, in particular the acidifying agent. The resulting composition is quite robust from the stability point of view and it does not lose stability when mixed with other acidic rinse-aid compositions or when stored under normal or high temperature conditions, as exist in the rinse-aid reservoir of a dishwashing machine.

DETAILED DESCRIPTION OF THE INVENTION

The present invention provides stable and preferably clear rinse-aid compositions comprising trisiloxane surfactants. Preferred embodiments comprise a glass-care agent. The invention also envisages a process for making the compositions.

In one aspect of the invention, the rinse-aid compositions comprise a trisiloxane surfactant, a non-ionic solubilising system and an acidifying agent and optionally a glass-care agent. The compositions may optionally comprise dispersants, hydrotropes, crystal growth inhibitors, conventional rinse-aid ingredients and mixtures thereof.

Polyalkoxylated Trisiloxane Surfactants

The polyalkoxylated trisiloxanes suitable for use herein have a polyalkyleneoxy residue of formula $(EO)_n(PO)_m$ wherein n is at least 3 and greater than m, where EO is ethoxy, PO propoxy and n and m are average numbers. Preferably, n is from about 3 to about 9, more preferably from about 4 to about 8 and m is from about 0 to about 4, preferably 1. The polyalkylenoxy residue is preferably attached to the trisiloxane via a short chain alkylene (eg propylene) linking moiety as described below and preferably terminates in a short chain alkyl or aryl moiety, "short chain" refers to a C1-C4 moiety.

The trisiloxane surfactant preferred for use herein is a polyalkoxylated modified dimethyltrisiloxane, preferably a linear methyltrisiloxane to which polyethers have been grafted through a hydrosilation reaction. This process results in an alkyl-pendant (AP type) copolymer, in which the polyalkoxylated groups are attached to the trisiloxane backbone through a series of hydrolytically stable Si—C bonds. The siloxane surfactants herein described are sold under the brand SILWET® available from Union Carbide or ABIL® polyethersiloxanes available from Goldschmidt Chemical Corp. Preferred siloxane for use herein are Silwet L77, Silwet L7280, Silwet L7607 and Silwet L7608. Silwet L7280 is especially preferred for its environmental profile. Other suitable siloxane surfactants are those supplied by Degusa (sold under the numbers 5840, 5847 and 5878), DowCorning (sold under the numbers DC 5211 and DC5212) and Wacker (sold under the number L066).

These compounds are also known by the name of siloxane polyoxyalkylene copolymers, siloxane polyethers, polyalkylene oxide silicone copolymers, silicone poly(oxyalkylene) copolymers, silicone glycol copolymers (or surfactants).

Preferred polyalkoxylated methylsiloxane surfactants for use herein have a surface tension of less than 25 mN/m, preferably less than 22 mN/m as measured in a 1% by weight aqueous solution at 20° C.

Non-Ionic Solubilising System

The non-ionic solubilising system can be a single non-ionic surfactant or a mixture thereof having a cloud point above room temperature (20° C.), preferably above 40° C., more preferably above 60° C. "Cloud point", as used herein, is a well known property of nonionic surfactants which is the result of the surfactant becoming less soluble with increasing temperature, the temperature at which the appearance of a second phase is observable is referred to as the "cloud point" (See KirkOthmer's Encyclopedia of Chemical Technology, 3rd Ed., Vol. 22, pp. 360-362).

Wetting Surfactants

Preferred wetting surfactants for use herein include alkyl ethoxylate condensation products of aliphatic alcohols with an average of from about 4 to about 10, preferably form about 5 to about 8 moles of ethylene oxide per mol of alcohol are suitable for use herein. The alkyl chain of the aliphatic alcohol generally contains from about 6 to about 15, preferably from about 8 to about 14 carbon atoms. Particularly preferred are the condensation products of alcohols having an alkyl group containing from about 8 to about 13 carbon atoms with an average of from about 6 to about 8 moles of ethylene oxide per mole of alcohol. Preferably at least 25%, more preferably at least 75% of the surfactant is a straight-chain ethoxylated primary alcohol. It is also preferred that the HLB (hydrophilic-lipophilic balance) of the surfactant be from about 7 to about 20. Commercially available products for use herein include Lutensol®TO series, C13 oxo alcohol ethoxylated, supplied by BASF, especially suitable for use herein being Lutensol®TO7.

The wetting surfactant(s) is preferably used in a level of from about 5% to about 40%, more preferably from about 8% to about 35% and even more preferably form about 10% to about 30% by weight of the composition.

Other suitable non-ionic surfactants having a cloud point above room temperature include those found at WO 00/50552, page 8, third to fifth paragraphs and include commercial materials such as Tergitol 15S9 (supplied by Union Carbide), Rhodasurf TMD 8.5 (supplied by Rhone Poulenc), and Neodol 91-8 (supplied by Shell).

Suds Suppresser Non-Ionic Surfactants

The non-ionic surfactants for use as suds suppressers have a low cloud point. For the purpose of this invention what is important is the cloud point of the system and not of the individual surfactants. Surfactants having a low cloud point are used in combination with surfactants having a high cloud point in order to form a system having a cloud point above room temperature (20° C.), preferably above 40° C., more preferably above 60° C. As used herein, a "low cloud point" non-ionic surfactant is defined as a non-ionic surfactant system ingredient having a cloud point of less than 30° C., preferably less than about 20° C., and even more preferably less than about 10° C., and most preferably less than about 7.5° C. Typical low cloud point non-ionic surfactants include non-ionic alkoxylated surfactants, especially ethoxylates derived from primary alcohol, and polyoxypropylene/polyoxyethylene/polyoxypropylene (PO/EO/PO) reverse block polymers. Also, such low cloud point non-ionic surfactants include, for example, ethoxylated-propoxylated alcohol (e.g., Olin Corporation's Poly-Tergent® SLF18) and epoxy-capped poly(oxyalkylated) alcohols (e.g., Olin Corporation's Poly-Tergent® SLF18B series of non-ionics, as described, for example, in U.S. Pat. No. 5,576,281).

Other suitable low cloud point surfactants are the ether-capped poly(oxyalkylated) suds suppresser having the formula:

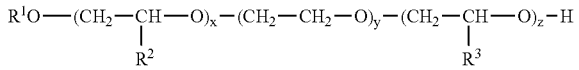

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point non-ionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

If non-ionic suds suppressers are used they are preferably used in a level of from about 5% to about 40%, preferably from about 8% to about 35% and more preferably form about 10% to about 25% by weight of the composition.

Acidifying Agent

Any suitable organic and/or inorganic acid may be used in the rinse-aid composition of the invention. Some suitable acids include, but are not limited to: acetic acid, aspartic acid, berizoic acid, boric acid, bromic acid, citric acid, formic acid, gluconic acid, glutamic acid, hydrochloric acid, lactic acid, malic acid, nitric acid, sulfamic acid, sulfuric acid, tartaric acid, and mixtures thereof. Preferred for use herein is citric acid.

The addition of an acid to the rinse-aid composition enables the water-soluble metal salt to at least partially dissolve, and preferably to fully dissolve, in the composition. Suitable acids are typically present in the rinse-aid compositions in the range from about 0.01% to about 25%, preferably from about 0.5% to about 20%, and more preferably from about 1% to about 10%, by weight of the composition. The level of acidifying agent required for the compositions of the invention is such as to achieve the desired pH, i.e. from about 1 to about 4.5 as measured in a 1% aqueous solution at 20° C.

Glass-Care Water-Soluble Salt

Water-soluble salts of aluminium, zinc, magnesium, calcium, lanthanum, tin, gallium, strontium, titanium, and mixtures thereof are suitable as glass-care water-soluble salt.

Suitable water-soluble zinc salts include, but are not limited to: zinc acetate, zinc benzoate, zinc borate, zinc bromide, zinc chloride, zinc formate, zinc gluconate, zinc lactate, zinc laurate, zinc maleate, zinc nitrate, zinc perborate, zinc sulfate, zinc sulfamate, zinc tartarate, and mixtures thereof.

Suitable water-soluble aluminium salts include, but are not limited to: aluminium acetate, aluminium ammonium sulfate, aluminium chlorate, aluminium chloride, aluminium chlorohydrate, aluminium diformate, aluminium formoacetate, aluminium monostearate, aluminium lactate, aluminium nitrate, aluminium sodium sulfate, aluminium sulfate, aluminium stearate, aluminium tartrate, aluminium triformate, and mixtures thereof.

Water-soluble magnesium salts include, but are not limited to: magnesium acetate, magnesium acetylacetonate, magnesium ammonium phosphate, magnesium benzoate, magnesium borate, magnesium borocitrate, magnesium bromate, magnesium bromide, magnesium chloride, magnesium chlorate, magnesium chloride, magnesium citrate, magnesium dichromate, magnesium fluorosilicate, magnesium formate, magnesium gluconate, magnesium glycerophosphate, magnesium lauryl sulfate, magnesium nitrate, magnesium perchlorate, magnesium permanganate, magnesium salicylate, magnesium stannate, magnesium stannide, magnesium sulfate, and mixtures thereof.

Water-soluble calcium salts include, but are not limited to: calcium acetate, calcium acetylsalicylate, calcium acrylate, calcium ascorbate, calcium borate, calcium bromate, calcium bromide, calcium chlorate, calcium chloride, calcium cyclamate, calcium dehydroacetate, calcium dichromate, calcium disodium edetate, calcium ethylhexoate, calcium formate, calcium gluconate, calcium iodate, calcium nitrite, calcium pantothenate, calcium perborate, calcium perchlorate, calcium permanganate, calcium propionate, calcium tartate, and calcium thiocynilate, and mixtures thereof.

If present the level of the salt(s) in the rinse-aid composition is from about 1% to about 20%, preferably from about 3 to about 10% by weight of the composition. Preferably the compositions will provide from about 0.1 ppm to about 1,000 ppm, more preferably from about 1 to about 500 ppm and even more preferably from about 20 to about 300 ppm of the corresponding metal ions. Preferably the composition comprises from about 0.5 to about 500 ppm, more preferably from about 0.5 to about 20 ppm of zinc ions and from about 1 to about 800 ppm, more preferably from about 10 to about 100 ppm of magnesium ions in the rinse liquor.

Organic Solvent System for the Magnesium Salt

The solvent system for the magnesium salt should be able to solubilise the magnesium salt in the required amount as well as maintain the rinse-aid composition in the form a single phase solution. Preferably, the solvent system has a flash point above room temperature, more preferably above 40° C. and even more preferably above 60° C.

The organic solvent system can be a single solvent but preferably is a mixture of solvents. Preferred mixtures are those comprising an alcohol, preferably a having a low vapour pressure, and a polyol. Preferred alcohols include low molecular weight alcohols, including ethanol, methanol, propanol and isopropanol. Preferred polyols include pentanediols, butanediols, propanediols, such as 1,2-propane diol, 1,3-propane diol, ethylene glycol and polyethylene glycols. Preferred mixtures comprise the polyol and alcohol in a weight ratio of at least about 3:1, more preferably at least about 5:1 and even more preferably at least about 8:1.

Specially preferred for use herein are systems comprising 1,2-propanediol and ethanol, in a weight ratio at least about 8:1. Preferably the alcohol is present in a level of from about 0.5 to 20%, more preferably from about 0.8 to about 5% by weight of the composition. Preferably the level of polyol if present is from about 1% to about 30%, more preferably from about 5 to about 20% by weight of the composition.

Process

The process of the invention requires the formation of a homogeneous premix of the trisiloxane surfactant and the solubilising system.

Separately an aqueous solution containing the reminder of the ingredients is prepared. Firstly, water is taken to the desired pH by the addition of the acidifying agent. Once the water is taken to the desired pH, the glass-care agent, if present, is added. In the case in which the glass-care agent comprises a mixture including a zinc salt, the zinc salt is added and dissolved before adding the rest of the salts. Afterwards the solvent system for the magnesium salt, if present is added. This is followed by the addition of the optional ingredients and finally the trisiloxane-solubilising system premix.

EXAMPLE

The following rinse composition is prepared by forming a premix of Silwet L7280, Lutensol TO7 and LF224. In a separate vessel distilled water is brought to a pH of about 3.5 by the addition of citric acid. This is followed by the addition of $ZnCl_2$ and then $MgCl_2$. After the chloride salts have dissolved ethanol, propanediol and perfume are added to the mixture and finally the premix is added to this mixture. The resulting composition is visually clear, stable and provides excellent rinse aid performance and glass care.

| | Example 1 |
|---|---|
| Silwet L7280[1] | 2.0 |
| Lutensol TO7[2] | 24 |
| LF224[3] | 12 |
| Citric acid | 3.10 |
| $ZnCl_2$ | 0.24 |
| $MgCl_2$ | 6.0 |
| Sodium xylene sulfonate | 6.50 |
| Ethanol | 1.50 |
| 1,2 propanediol | 12 |
| Perfume | 0.1 |
| DI water | To balance |

[1]Trisiloxane surfactant available from OSi Specialities
[2]C13 oxo alcohol ethoxylated, available from BASF
[3]Fatty alcohol alkoxylated non-ionic surfactant available from BASF The levels in the example are given as percentage by weight of the composition.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A rinse-aid composition comprising a polyalkoxylated trisiloxane surfactant and a non-ionic solubilising system having a cloud point above room temperature, a mixture of a zinc salt and a magnesium salt and an acidifying agent wherein the rinse-aid composition has a pH of from about 1 to about 4.5 and the solubilising system and the trisiloxane surfactant are in a weight ratio of at least about 1:1.

2. A rinse-aid composition according to claim 1 wherein the trisiloxane surfactant has a polyalkyleneoxy residue and the polyalkyleneoxy residue of the trisiloxane surfactant has the general formula $(EO)_n(PO)_m$ wherein EO is ethoxy, PO is propoxy, n is at least about 3 and greater than m and wherein the composition comprises from about 0.1 to about 10% by weight of the composition of trisiloxane surfactant.

3. A rinse-aid composition according to claim 1 wherein the solubilising system comprises a wetting surfactant having a surface tension of 35 mN/m or below.

4. A rinse-aid composition according to claim 1 wherein the solubilising system comprises a mixture of a wetting surfactant and a low foaming non-ionic surfactant acting as a suds suppressor wherein the wetting surfactant and the suds suppressor are in a weight ratio of at least 1:1.

5. A rinse-aid composition according to claim 1 further comprising a glass-care agent said glass-care agent being a water-soluble salt of at least one metal selected from the group consisting of aluminium, calcium, lanthanum, tin, gallium, strontium, titanium, and mixtures thereof.

6. A rinse-aid composition according to claim 1 further comprising an organic solvent system comprising an alcohol and a polyol.

7. A rinse-aid composition according to claim 5 further comprising a solvent system comprising an alcohol and a polyol.

8. A method of making a rinse-aid composition comprising a polyalkoxylated trisiloxane surfactant and a non-ionic solubilising system having a cloud point above room temperature, a mixture of a zinc salt and a magnesium salt and an acidifying agent wherein the rinse-aid composition has a pH of from about 1 to about 4.5 and the solubilising system and the trisiloxane surfactant are in a weight ratio of at least about 1:1 comprising:

a) forming a premix of the trisiloxane surfactant with the solubilising system; and b) adding the resulting premix to the acidifying agent.

* * * * *